US006407043B1

(12) United States Patent
Moehr

(10) Patent No.: US 6,407,043 B1
(45) Date of Patent: Jun. 18, 2002

(54) LUBRICATING GREASE COMPOSITION AND PREPARATION

(75) Inventor: Soenke Moehr, Boostedt (DE)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/622,483

(22) PCT Filed: Feb. 15, 1999

(86) PCT No.: PCT/EP99/00983

§ 371 (c)(1),
(2), (4) Date: Oct. 13, 2000

(87) PCT Pub. No.: WO99/42541

PCT Pub. Date: Aug. 26, 1999

(30) Foreign Application Priority Data

Feb. 17, 1998 (GB) ..... 9803367

(51) Int. Cl.[7] ..... C10M 117/00; C10M 115/08; C10M 177/00

(52) U.S. Cl. ..... 508/158; 508/155; 508/518; 508/519; 508/539; 508/552

(58) Field of Search ..... 508/155, 158, 508/519, 539, 552

(56) References Cited

U.S. PATENT DOCUMENTS

| | | | | | |
|---|---|---|---|---|---|
| 3,475,335 | A | | 10/1969 | Greene | |
| 3,791,973 | A | | 2/1974 | Gilani et al. | 252/41 |
| 3,940,339 | A | * | 2/1976 | Clarke, Jr. et al. | 252/18 |
| 3,988,248 | A | * | 10/1976 | Grasshoff | 252/18 |
| 4,165,329 | A | | 8/1979 | Dreher | |
| 4,297,227 | A | | 10/1981 | Witte et al. | 252/18 |
| 4,336,203 | A | | 6/1982 | Zucker et al. | 260/417 |
| 4,376,060 | A | * | 3/1983 | Stadler | 252/42.1 |
| 4,444,669 | A | | 4/1984 | Wittse et al. | 252/41 |
| 4,802,999 | A | * | 2/1989 | Koizumi et al. | 252/18 |
| 5,236,607 | A | | 8/1993 | Harris et al. | 252/41 |
| 5,350,531 | A | | 9/1994 | Musilli | 252/41 |
| 5,714,444 | A | | 2/1998 | Yokouchi et al. | 508/539 |
| 6,022,835 | A | * | 2/2000 | Fletcher | 508/365 |
| 6,063,743 | A | | 5/2000 | Seubert | |

FOREIGN PATENT DOCUMENTS

| | | | |
|---|---|---|---|
| DE | 19622906 | 12/1997 | C10M/169/00 |
| EP | 0084910 | 8/1983 | C10M/5/14 |
| GB | 776548 | 6/1957 | |
| GB | 788510 | 1/1958 | |
| WO | WO95/35355 | 12/1995 | |

* cited by examiner

*Primary Examiner*—Ellen M. McAvoy
(74) *Attorney, Agent, or Firm*—William G. Muller

(57) ABSTRACT

Greases having low noise properties are prepared by cycling kettle contents, during at least the initial stage of soap-forming or other thickening, round a processing loop comprising (i) agitation and heating and (ii) shearing. Lithium complex greases are referred to which have lower noise properties than a polyurea type grease.

23 Claims, No Drawings

LUBRICATING GREASE COMPOSITION AND PREPARATION

The present invention relates to a lubricating grease composition and preparation thereof, being more especially concerned with lubricating greases having improved consistency and homogeneity and low noise characteristics.

The lubricating grease types with which the invention is concerned comprise a major proportion of a lubricating base oil and a minor proportion of a simple soap or a complex soap thickener or of an organic thickener or inorganic clay thickener, such grease types include but are not limited to lithium simple and complex soap greases, calcium simple and complex soap greases, sodium simple and complex greases, aluminium simple and complex greases, barium simple and complex greases; as well as polyurea greases, organo-clay greases and bentonite clay/swelling-clay type thickeners.

It is an object of the present invention to provide a grease in which the thickener is of improved, e.g. smaller, more uniform, particle size. Such an improved structure will endow most grease types with e.g. improved consistency and useful life-time, and reduced oil separation. Although of general relevance, such an improved thickener is of especial advantage in lithium simple and complex soap greases.

As an example, lithium complex soap greases have found a major use as greases for bearings, particularly sealed bearings e.g. in automobiles and electrical appliances. Sealed bearing greases must meet numerous performance requirements including extended bearing life, high temperature performance, high dropping point; and defined requirements relating to oil separation, oxidation stability, fretting wear protection and low noise. However, although offering long service and high temperature benefits, such greases often suffer from generally higher noise characteristics than a lithium simple grease.

It is a further object of the present invention to provide a lubricating grease in general, but more especially a lithium complex grease, having reduced noise characteristics.

In accordance with one aspect of the present invention there is provided a method of preparing a lubricating grease composition having a major proportion of lubricating base oil and a minor proportion of a simple soap or a complex soap thickener system, or of an organic thickener system or inorganic clay thickener system; which method includes the steps of:

(a) agitating and heating the soap-forming or other grease-thickening constituent(s) with at least a portion-of the lubricating base oil in a closed reaction vessel over a temperature range and for a period of time sufficient to form a soap or other thickener system, (b) cycling at least a portion of the contents of the reaction vessel, during at least the initial stage of the soap-forming, or other thickening, period, one or more times round a pressure-ventable closed processing loop comprising (i) the said agitating and heating in the reaction vessel and (ii) shearing the forming soap, or other thickener, in mechanical shearing means.

It is much preferred to conduct the cycling step (b) more than once during the said initial stage; and very preferably it is conducted over substantially the full soap-forming, or other thickening, period. Preferably, too, substantially all of the contents of the reaction vessel are cycled in at least one of the cycles of step (b); and, more preferably, in substantially all cycles.

The mechanical shearing is very preferably conducted with a shearing/milling/grinding gap of between 50 $\mu$m and 2000 $\mu$m, especially from 50 $\mu$m to 500 $\mu$m, more especially 100 $\mu$m to 500 $\mu$m. Suitably the mechanical shearing may be conducted employing one of the SUPRATON® machines e.g. the S400 model commercially available from Krupp Industrietechnik GmbH, Grevenbroich, Germany. Gaps between stator and rotor are set within the above ranges and, very preferably, reaction mix from the reactor is fed such that the dwell period of the material in the grinding gap is as extended as possible.

The following description relates to soaps and soap-forming, but is relevant to, and does not exclude, other types of thickening as referred to above.

In the reaction vessel (grease-making kettle) itself the soap-forming constituents are heated over a continuing temperature gradient and agitated (i.e. thoroughly mixed, for example by means of a double-motion agitator) both initially and upon each return from shearing. The combination of the steps (a) and (b) of the process of the invention permits the generation of an extremely large and active contact surface between reactants with slow evaporation of water. As a result crystallization occurs such that the soap structure formed has, among other properties, a small size and a high measure of noise-absorption.

The invention thus provides a means of greatly decreasing that portion of the noise-causing characteristics of a grease which are due to the internal soap crystal structure per se. It is known that externally introduced contaminants will increase the noise rating of a grease, for example, reaction components contaminated prior to or during manufacture. Therefore, it is highly preferred in the process of the present invention to employ components in as impurity-free form as possible, such as by filtering them in liquid form through break-proof filter systems. In this way noise level of the grease product is still further decreased. However, the essence of the present invention is a significant reduction in noise due to the internal soap crystal structure; and it is achieved by the controlled crystallisation which occurs during the saponification stage of the process of the invention.

A wide variety of lubricating base oils can be employed in the process and grease compositions of the present invention. Thus, the lubricating oil base can be any of the conventionally used mineral oils, synthetic hydrocarbon oils or synthetic ester oils, or mixtures thereof depending upon the particular grease being prepared. In general these lubricating oils will have a viscosity in the range of about 5 to about 400 cSt at 40° C., although typical applications will require an oil having a viscosity ranging from about 10 to about 200 cSt at 40° C. Mineral lubricating oil base stocks used in preparing the greases can be any conventionally refined base stocks derived from paraffinic, naphthenic and mixed base crudes. Synthetic lubricating oils that can be used include esters of glycols such as a $C_{13}$ oxo acid diester of tetraethylene glycol, or complex esters such as one formed from 1 mole of sebacic acid and 2 moles of tetraethylene glycol and 2 moles of 2-ethylhexanoic acid. Other synthetic oils that can be used include synthetic hydrocarbons such as polyalphaolefins; alkyl benzenes, e.g., alkylate bottoms from the alkylation of benzene with tetrapropylene, or the copolymers of ethylene and propylene; silicone oils, e.g., ethyl phenyl polysiloxanes, methyl polysiloxanes, etc., polyglycol oils, e.g., those obtained by condensing butyl alcohol with propylene oxide; carbonate esters, e.g., the product of reacting $C_8$ oxo alcohol with ethyl carbonate to form a half ester followed by reaction of the latter with tetraethylene glycol, etc. Other suitable synthetic oils include the polyphenyl ethers, e.g., those having from about 3 to 7 ether linkages and about 4 to 8 phenyl groups.

For lithium complex soap greases, preferred thickeners contain two, more preferably, three lithium components. The first may be a lithium soap of at least one, hydroxy fatty acid, preferably $C_{12}$ to $C_{29}$. The second may be selected from a lithium compound of (i) a $C_2$ to $C_{12}$ aliphatic or cycloaliphatic dicarboxylic acid (or $C_1$ to $C_{10}$, such as $C_1$ to $C_4$, alkyl ester thereof); or (ii) of a $C_3$ to $C_{24}$ hydroxy carboxylic acid (or $C_1$ to $C_{10}$, such as $C_1$ to $C_4$, alkyl ester thereof ) which has the hydroxy group separated from the carboxyl group by six or less carbon atoms; or a mixture thereof. The third component, which is very preferably present, is a lithium salt of boric acid.

Preferred hydroxy fatty acids include hydroxystearic, hydroxy-ricinoleic, hydroxybehenic and hydroxypalmitic. Especially preferred is 12-hydroxystearic acid. The second lithium compound is preferably a $C_6$ to $C_{10}$ aliphatic dicarboxylic acid, more preferably azelaic or sebacic acids, especially azelaic acid, or said ester of any of these. The $C_3$ to $C_{24}$ hydroxy-carboxylic acid is preferably lactic acid, salicylic acid or other hydroxy-benzoic acid, more preferably salicylic acid or a said ester of any of these. The amount of lithium soap complex thickeners is very preferably from 5 to 20 wt. %, based on grease. The weight ratio of hydroxy fatty acid to aliphatic dicarboxylic acid and/or hydroxy-carboxylic acid is preferably from 10:0.5 to 10:15, very preferably 10:1.5 to 10:6. The weight ratio of boric acid to the dicarboxylic and/or hydroxy carboxylic acid will preferably be from 1:5 to 1:20 very preferably 1:10 to 1:15.

In accordance with another aspect, the invention provides lubricating greases, both as broadly and more specifically defined herein, having a noise level of not above 3.5 units when measured by the SKF "BEQUIEI" test rig referred to herein. A level of 2.0 to 3.0 units is one achievable range.

In accordance with the invention, there is provided a lubricating grease composition comprising (i) a major amount by weight of a lubricating base oil; (ii) from 2 to 30 wt. %, preferably 2 to 20 wt. %, of a lithium complex soap thickener; and (iii) 0 to 10 wt. %, suitably 0 to 5 wt. %, of conventional additives, and having (a) a noise level below 3.5 units when measured as herein referred to.

Such a lithium complex grease will normally have a dropping point (ASTM D 566-87) of at least 270° C., usually at least 2900° C.

The following Examples are given as non-limitative illustration of aspects of the present invention.

EXAMPLE 1

A lithium complex grease was made employing a paraffinic base oil of 100 to 120 cSt at 40° C., 12-hydroxystearic acid, lithium hydroxide, methyl salicylate and boric acid, in proportions approximating to those conventionally employed. The base oil and pre-solutions of components were filtered to <50 μm and <25 μm for water-soluble and oil-soluble components respectively (although in general, it will be found more advantageous to employ filters of the same mesh size, and in the order of about 10 μm).

The 12-hydroxystearic acid and a minor, solubilising, quantity of the base oil were heated to approximately 85° C. The pre-solution was filtered and pumped into a closed kettle.

The methyl salicylate was added to the closed kettle at approximately 80° C. and heating commenced. When the temperature reached about 95° C., a pre-made aqueous solution (at about 95° C.) of lithium hydroxide and boric acid was added to the closed vessel. The reactor contents were kept thoroughly agitated throughout the manufacture. As from the time the LiOH was added, substantially the entire reaction mixture was fed around a closed ventable loop which included a shearing stage at less than 500 μm stator/rotor slit width in a SUPRATON® Mill referred to herein. (The term "shearing" as used herein encompasses shearing, grinding, milling and homogenising). The cycling was continued in a substantially constant manner.

Heating was continued to 140° C., whereupon a further portion of the base oil was added to the kettle. Heating was continued to approximately 190° C., whilst continuing the circulation of mix through the mill. At that point the cycling was stopped, the kettle cooled and conventional corrosion inhibitor and antioxidant were added in a further amount of the base oil and blended in.

Finally, the remainder of the base oil was added and the whole blended to produce a final grease having a penetration of approximately inid-NLGI 3 range, 220–250 units.

EXAMPLE 2

The noise characteristics of three lithium complex greases prepared in accordance with the procedure of Example 1 were compared with those of (A) the grease of Samples 4 and 12 described in WO 95/35355 and (B) a commercially available polyurea grease known to exhibit low noise properties.

The test was made employing the commercially available SKF "BEQUIET" test rig MVH 90B, obtainable from the SKF Company, Sweden. The noise level results obtained by this method, so-called Anderometry, are expressed in the unit "μm/second". The Table shows the results obtained and compares them in the first two cases with results quoted in Example 2 of WO 95/35355 measured by the method of JP 53–2357.

| | Noise Units JP 95/35355 (count./120 sec) | Noise Units SKF Bequiet Test Rig (μm/sec) |
|---|---|---|
| (1) Sample 4 of WO 95/35355 | 7,308 | 30.5 |
| (2) Sample 12 of WO 95/35355 | 83 | 7.2 |
| (3) Commercial polyurea grease | — | 3.7 |
| (4) Grease I of invention | — | 3.0 |
| (5) Grease II of invention | — | 2.7 |
| (6) Grease III of invention | — | 2.6 |

The greases of the invention give rise to appreciably lower noise levels than (2) and (3) (based on the same test rig), being at least 20% better than even the polyurea grease (3). Grease composition (1) omits the dispersant present in grease (2).

In general, the invention achieves superior reduction in noise levels through controlled crystallization during saponification rather than by added chemical components. The prior art greases essentially require dispersant type compounds to be added to achieve noise reduction, vide WO 95/35355, EP 0 084 910 and EP 0 718 394.

What is claimed is:

1. A lubricating grease composition comprising (i) a major amount by weight of a lubricating base oil; (ii) from 2 to 30wt % of a thickener selected from a simple soap, a complex soap, or polyurea; and (iii) 0–10 wt % of other additives characterised in that said composition has a small, uniform internal soap crystal particle size structure and a noise level below 3.5 μm/sec measured by Anderometry employing a SKF "BEQUIET" test rig MVH 90B.

2. The lubricating grease composition according to claim 1 wherein the thickener (ii) is derived from one or more soap of the group consisting of lithium, calcium, sodium, aluminum and barium soaps.

3. The lubricating grease composition according to claim 2 wherein the thickener (ii) is derived from a lithium complex soap.

4. The lubricating grease composition according to claim 1 wherein the thickener (ii) is present in an amount of 2 to 20 wt %.

5. The lubricating grease composition according to claim 2 wherein the thickener (ii) is present in an amount of 2 to 20 wt %.

6. The grease composition according to claim 3 wherein the lithium complex soap thickener comprises a lithium $C_{12}$ to $C_{24}$ hydroxycarboxylate, a lithium salt of a $C_3$ to $C_{14}$ hydroxy carboxylic acid or lower alkyl ester thereof.

7. The grease composition according to claim 4 wherein the lithium complex soap thickener contains in addition lithium borate.

8. The grease composition according to claim 7 wherein the lithium complex soap thickener contains in addition lithium borate.

9. The grease composition according to claim 1 wherein said composition is substantially free of dispersants.

10. The grease composition according to claim 1 wherein said composition has a dropping point of at least 270° C.

11. A process of preparing a lubricating grease composition comprising (i) a major amount by weight of a lubricating base oil; (ii) from 2 to 30 wt % of a thickener selected from a simple soap, a complex soap, or polyurea; and (iii) 0–10 wt % of other additives, said method comprising:

(a) agitating and heating a thickener forming component with at least a portion of the lubricating base oil in a closed reaction vessel over a continuing temperature gradient by range, and (b) cycling at least a portion of the contents of the reaction vessel over substantially the full thickening period round a pressure-ventable processing loop comprising (a) the said agitating and heating, and (c) shearing the forming thickener component by mechanical shearing means.

12. A process according to claim 11 wherein during the cycling step (b) substantially all of the contents of the reaction vessel are cycled.

13. A process according to claim 11 wherein the shearing step (c) is conducted at a stator/rotor clearance of between 50 $\mu$m and 2000 $\mu$m.

14. A process according to claim 12 wherein the shearing step (c) is conducted at a stator/rotor clearance of between 50 $\mu$m and 2000 $\mu$m.

15. A process according to claim 13 wherein the shearing step (c) is conducted at a stator/rotor clearance of between 100 $\mu$m and 500 $\mu$m.

16. A process according to claim 14 wherein the shearing step (c) is conducted at a stator/rotor clearance of between 100 $\mu$m and 500 $\mu$m.

17. A process according to claim 11 wherein said method is conducted in the absence of any added noise reduction compound.

18. The grease composition according to claim 1 in which the thickener is polyurea.

19. The grease composition according to claim 1 in which the additives, if present, exclude a noise reduction compound.

20. The grease composition according to claim 1 wherein the simple or complex soap thickener comprises one or more of the group consisting of lithium 12-hydroxy stearate, lithium azelate or salicylate or their methyl esters, and lithium borate.

21. The process according to claim 11 wherein the simple soap or complex soap is one or more soap of the group consisting of lithium, calcium, sodium, aluminum and barium soaps.

22. The process according to claim 21 wherein the simple soap or complex soap is complex lithium soap.

23. The process according to claim 11 in which the thickener is polyurea.

* * * * *